US008980378B2

(12) United States Patent
Soegaard Jensen et al.

(10) Patent No.: US 8,980,378 B2
(45) Date of Patent: Mar. 17, 2015

(54) METHOD AND SYSTEM FOR COATING A SURFACE WITH A VISCOUS ONE OR PLURAL COMPONENT COATING MATERIAL

(75) Inventors: Thomas Soegaard Jensen, Vejle (DK); Michael Klaesoee, Vejle (DK)

(73) Assignee: Pieter Mouritsen A/S, Vejle (DE)

( * ) Notice: Subject to any disclaimer, the term of this patent is extended or adjusted under 35 U.S.C. 154(b) by 147 days.

(21) Appl. No.: 13/582,672

(22) PCT Filed: Feb. 23, 2011

(86) PCT No.: PCT/DK2011/050056
§ 371 (c)(1),
(2), (4) Date: Sep. 4, 2012

(87) PCT Pub. No.: WO2011/107098
PCT Pub. Date: Sep. 9, 2011

(65) Prior Publication Data

US 2012/0328791 A1 Dec. 27, 2012

(30) Foreign Application Priority Data

Mar. 1, 2010 (DK) ..... 2010 00161

(51) Int. Cl.

| | |
|---|---|
| ***B05D 1/02*** | (2006.01) |
| ***B05B 7/24*** | (2006.01) |
| ***B05B 7/04*** | (2006.01) |
| ***B05B 7/16*** | (2006.01) |

(52) U.S. Cl.
CPC ..... *B05B 7/2494* (2013.01); *B05B 7/0416* (2013.01); *B05B 7/164* (2013.01); *B05B 7/166* (2013.01); *B05B 7/1693* (2013.01); *B05B 7/2491* (2013.01)
USPC ..... 427/427; 427/421.1; 239/428; 451/527

(58) Field of Classification Search
USPC ..... 427/427, 421.1; 239/428; 451/527
See application file for complete search history.

(56) References Cited

U.S. PATENT DOCUMENTS

| | | | | |
|---|---|---|---|---|
| 5,178,326 | A | 1/1993 | Kukesh et al. | |
| 5,645,217 | A * | 7/1997 | Warren | 239/75 |
| 6,319,559 | B1 * | 11/2001 | Makino | 427/422 |
| 2001/0030241 | A1 | 10/2001 | Kott et al. | |
| 2004/0209561 | A1 * | 10/2004 | Suzuki et al. | 451/527 |
| 2008/0075875 | A1 | 3/2008 | Milli | |

FOREIGN PATENT DOCUMENTS

| | | |
|---|---|---|
| DE | 101 37 711 | 2/2003 |
| FR | 1.114.098 | 11/1954 |

OTHER PUBLICATIONS

International Search Report for International Application No. PCT/DK2011/050056 mailed May 24, 2011.

* cited by examiner

*Primary Examiner* — Nathan T Leong
(74) *Attorney, Agent, or Firm* — Merchant & Gould P.C.

(57) ABSTRACT

There is provided a system and method to spray viscous coating materials comprising abrasive particles, such as Silicium Carbide. Such coating materials are e.g. advanced ceramic composites formulated to protect equipment from corrosion and erosion. In particular the method and the system is able to spray and evenly coat a surface with two component materials based on modified epoxy resin and aliphatic curing agent loaded with abrasive ceramic particles.

8 Claims, 1 Drawing Sheet

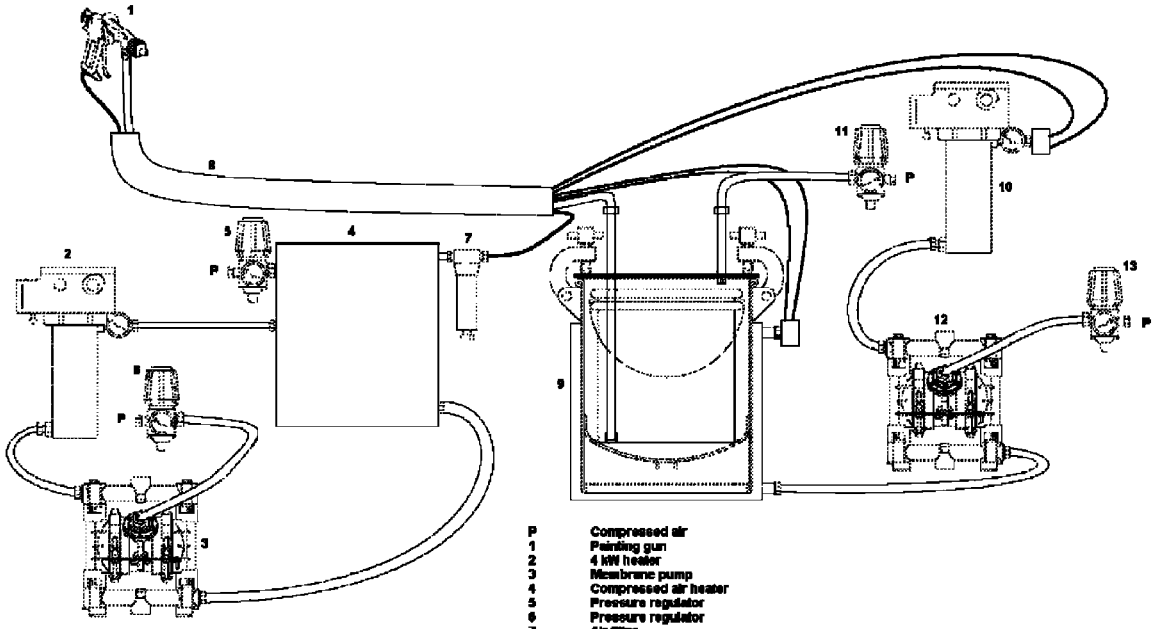
| | |
|---|---|
| P | Compressed air |
| 1 | Painting gun |
| 2 | 4 kW heater |
| 3 | Membrane pump |
| 4 | Compressed air heater |
| 5 | Pressure regulator |
| 6 | Pressure regulator |
| 7 | Air filter |
| 8 | Paint hos with heating and insulation |
| 9 | Pressure tank |
| 10 | 4 kW heater |
| 11 | Pressure regulator |
| 12 | Membrane pump |
| 13 | Pressure regulator |

METHOD AND SYSTEM FOR COATING A SURFACE WITH A VISCOUS ONE OR PLURAL COMPONENT COATING MATERIAL

This application is a National Stage Application of PCT/DK2011/050056, filed 23 Feb. 2011, which claims benefit of Serial No. PA 2010 00161, filed 1 Mar. 2010 in Denmark and which applications are incorporated herein by reference. To the extent appropriate, a claim of priority is made to each of the above disclosed applications.

FIELD OF THE INVENTION

The present invention relates generally to spraying systems and, more particularly to air-assisted one or plural component spraying systems and methods.

BACKGROUND OF THE INVENTION

Multi-component spraying systems have a multiplicity of applications, each with its specific requirements and limitation. In some prior art systems the liquid components carries a significant quantity of spray particles-away from the substrate, wastes the expensive material, creates an unclean spray area and generally requires overspray collection systems and contributes to the problem of operating such manufacturing operations safely.

In prior systems, spray nozzles have been used to atomize liquid materials which are pumped at high pressure, that is, pressures generally exceeding 30 Bar. Liquid material pumped at high pressures through such spray nozzles is forced by the hemispherical termination of the passageway to converge in its flow at and through the elongated orifice. Because of the converging flow at the orifice, the liquid material is expelled through the orifice into a planar, expanding, fan-like film which breaks into spray particles which are carried by their momentum to the article target. With viscous fluids, high pressures of 60-65 Bar are normally required. Such high operating-pressures impose a strain on system components reducing their reliability, require generally expensive components in the fluid delivery systems and contribute to the problem of operating such systems safely. Even at high pressures, however, such fan-like films, because they are formed by the convergence of the fluid, include heavy streams at the edges of the planar, fan-like film, which are referred to as "tails". Because of the heavy stream-like flow in the tails, the spray pattern formed by these edge portions of the expanding, fan-like film includes a disproportionate quantity of material and produces a non-uniform deposit with stripes when the spray pattern is swept across a substrate by a spray gun operator. The non-uniform deposit and resulting stripes make the blending of deposited material into a film of uniform thickness virtually impossible.

One or plural components spraying methods and apparatus have been encumbered by the use of large spray guns attached to a one or plurality of hoses. Such guns were heavy, and their manipulation was resisted by a one or plurality of hoses attached at various locations to the spray gun body. These prior one or plural component systems and apparatus were, at least, commercially unattractive for industrial painting applications and, in many cases, unusable.

U.S. Pat. No. 5,178,326 discloses a spraying system for forming a coating on an article. The system disclosed in the patent provides effective and efficient mixing, atomization and deposition of plural component materials. The system follows a procedure, where a flow of compressed air is delivered to the spray gun and the combined flows of the plural component materials are mixed and formed into a fan-like film with expanding edges extending from the spray gun. The spraying system disclosed in this patent is not suitable for spraying viscous coating materials.

U.S. Pat. No. 5,645,217 discloses a spraying system for forming a coating on an article. The patent discloses a spray application system and method for a two-part, self-setting compound, comprising a source of the first part of the compound, a source of the second part of the compound, a spray device for applying the compound, a mixing assembly for intermingling the two parts of the compound, a heated hose downstream of the mixing device for delivering the compound to the spray device, a first pump or set of pumps for delivering the first part of the compound to the mixing device, and a second pump or set of pumps for delivering the second part of the compound to the mixing device. The spraying system disclosed in this patent is not suitable for spraying viscous coating materials.

US patent application no 20080075875A1 is directed to a painting system in which the temperature of the carrier fluid is kept at or brought to the required temperature at least at the moment of mixing. The spraying system disclosed in this patent is not suitable for spraying viscous coating materials.

French patent FR 1.114.098 discloses an apparatus for spraying coating viscose coating materials on surfaces, which comprising supplying of a pressure flow of coating material to a spraying means and supplying a flow of compressed air, connected to a tube piece, to assist formation of a particle spray. This patent does not envisage how coating material comprising abrasive particles may be sprayed without destroying the apparatus.

It is an object of the present invention to provide a system and method for coating a surface with a layer of viscous one or plural component coating material containing abrasive particles (e.g. SiC) with minimal wear on the system. Specifically, it is an object to provide a system and method for coating a surface with a layer of two component materials based on modified epoxy resin and loaded with abrasive ceramic particles, such as Silicium Carbide particles. Such coating material has not been possible to spray in prior art systems.

Finally it is an object of the present invention to provide a system for coating a surface with a layer of viscous one or plural component coating material, which system satisfy regulations for working on oil platforms, i.e. without risk of ignition of explosive fluids or gases. In this respect it is decisive that the system of the present invention may be used on fixed offshore platforms, in petrochemical plants where a potentially explosive atmosphere may be present. Such equipment is governed by the ATEX 95 equipment directive 94/9/EC, namely equipment and protective systems intended for use in potentially explosive atmospheres; the directive covers a large range of equipment, including equipment used on fixed offshore platforms, in petrochemical plants where a potentially explosive atmosphere may be present.

SUMMARY OF THE INVENTION

The present invention solves the above mentioned problems by providing a method of coating a surface with a viscous one or plural component coating material comprising abrasive particles, said method comprising the steps:

supplying a flow of pressurized one or plural component coating material to a spraying means;

supplying a flow of compressed air to said spraying means to assist in the formation of a particle spray; and directing the spray particles at the surface to be coated where the spray particles form a coating, characterized in that the temperature of the compressed air is kept between 40 and 80 degrees C. at the spraying means, and the pressure of the compressed air is between 0.5 and 7 bar; and the temperature of the viscous one or plural component coating material is kept at between 30 and 75 degrees C. at the spraying means.

The inventors of the present invention have surprisingly found that only when these parameters are fulfilled it is possible to spray viscous coating materials comprising abrasive particles, such as Silicium Carbide. Such coating materials are e.g. advanced ceramic composites formulated to protect equipment from corrosion and erosion. In particular the method and the system of the present invention is able to spray and evenly coat a surface with two component materials based on modified epoxy resin and aliphatic curing agent loaded with abrasive ceramic particles, such as Silicium Carbide particles.

In light of the demanding robustness of the spraying means the spray gun preferably comprises a gun body and a fluid nozzle comprising a bore located in said gun body, said bore comprising a seat and a restrictive area.

The inventors of the present invention have surprisingly found that when the temperature of the compressed air is kept between 40 and 80 degrees C., preferably between 50 and 75 degrees C., more preferably between 55 and 70 degrees C., a very even coating without blisters is achieved. The best results have been achieved when the temperature of the viscous one or plural component coating material is also kept at between 32 and 55 degrees C., preferably between 35 and 50 degrees C. In order to have a very stable spray the pressure of the compressed air should be between 1 and 7 bar, preferably between 4 and 6.5 bar, at the spraying means. In order to achieve a stable flow of one or plural component coating material it is pressurized by being kept at a pressure of 1 to 7 bar in a suitable pressure tank.

The method of the present invention is in contrast to prior art methods able to evenly spray a two component coating based on modified epoxy resin and loaded with abrasive ceramic particles, such as Silicium Carbide particles. This type of coating is normally applied manually by brush or applicator and has so far not been considered sprayable. It is highly unexpected that the method of the present invention renders such types of coatings sprayable.

The present invention furthermore provides a spraying system for forming a coating on a surface with a viscous one or plural component coating material comprising abrasive particles, said system comprising:

a source of pressurized viscous one or plural component coating material;

a source of compressed air;

spraying means for directing the coating material to the surface to be coated;

means for providing a flow of compressed air from said compressed air source to said spraying means;

means for providing a flow of coating material from said source of coating material to said spraying means;

a first source of hot non-explosive liquid for maintaining a constant temperature of said source of coating material;

a second source of hot non-explosive liquid for maintaining a constant temperature of said source of compressed air; and means for providing a flow of said hot non-explosive liquid from said first source of hot non-explosive liquid along the means for providing a flow of coating material so as to maintain the temperature of the coating material until it reaches the spraying means.

Accordingly, the inventors of the present invention have enabled a spraying system that can be used on fixed offshore platforms, in petrochemical plants where a potentially explosive atmosphere may be present. Hence, the present inventors have used hazardous location heaters (e.g. Viscon HP from Graco) and air operated diaphragma-pumps (e.g. Husky from Graco). Also, as appears from the appended claims non-explosive liquid is used to maintain the temperature of the coating material as well as the compressed air. Such non-explosive liquid is preferably selected from the group consisting of water, glycol, glycerol, paraffinic oils and pure silicones.

The means for providing a flow of compressed air and the means for providing a flow of coating material are preferably appropriate plastic tubing. These means are wholly or partly in contact with each other, e.g. the may be bundled with strips or placed in some sheath. Preferably no isolating material is placed between the means.

Concerning the spraying means the present system preferably employs a spray gun comprising a gun body and a fluid nozzle comprising a bore located in said gun body, wherein said bore comprises a seat and a restrictive area. Unexpectedly, the system of the present invention is able to spray a two component coating based on modified epoxy resin and loaded with abrasive ceramic particles, such as Silicium Carbide particles.

BRIEF DESCRIPTION OF THE DRAWING

The technical features of the present invention are set out in the claims herein and the advantages more clearly illustrated in the detailed description which follows, with reference to the accompanying drawing, which illustrates a preferred embodiment of the invention without limiting the scope of the inventive concept, and in which:

FIG. 1 is a view of an embodiment of the invention, with some parts cut away to better illustrate internal details.

DETAILED DESCRIPTION OF THE INVENTION

FIG. 1 schematically illustrates a one or plural component spraying system of the present invention. The system includes a source of pressurized viscous one or plural component coating material contained in a pressure tank (9). The system also includes a source of compressed air (P) kept at a desired temperature by a compressed air heater (4) in conjunction with a membrane pump (3) and at a desired pressure by pressure regulator (5). The one or plural component coating material contained in a pressure tank is kept at a desired pressure through the pressure regulator (11), and the desired temperature of the coating material is achieved by heating the pressure tank (with a water bath) in combination with an external heater (10) in conjunction with a membrane pump (12) and pressure regulator (13). The system is provided with insulated and heated hoses (8) to provide a flow of compressed air and coating material to a painting gun (1).

In the actual set-up the pressure tank (9) was a stainless steel pressure tank (high-pressure regulated) with agitator from Graco Inc. The heaters used were High Pressure Fluid Heaters (Viscon HP) from Graco Inc. The pumps used in the above specified system were Air Operated Diaphragm Pumps (Husky 716) from Graco Inc.

The method and system of the present invention has been tested and compared with prior art methods and systems. In particular a pump of the type GRACO King Extreme 68:1 was tested. The result of the test was that highly viscous and abrasive coating materials (such as Chesterton ARC 855 HT) cannot be sufficiently pumped to the spray gun. The problem is that prior art systems segregate the liquid and solid components of such viscous and abrasive coating materials leaving a sand-like mass in valves, piston, pistonrod and elsewhere in the system, which ultimately destroy the system, including gaskets and valves. The present inventors are not aware of any spray system that can cope with highly viscous and abrasive coating materials, while still producing a fine spray that can evenly coat a surface.

The invention claimed is:

1. A method of coating a surface with a viscous two component coating material comprising the steps:

supplying a flow of pressurized two component coating material to a spraying means;

supplying a flow of compressed air to said spraying means to assist in the formation of a particle spray; and directing the spray particles at the surface to be coated where the spray particles form a coating, wherein the temperature of the compressed air is kept between 40 and 80 degrees C. at the spraying means, and the pressure of the compressed air is between 0.5 and 7 bar; and wherein the temperature of the viscous two component coating material is kept at between 30 and 75 degrees C. at the spraying means, wherein the two component coating material is a paint comprising epoxy resin and abrasive ceramic Silicium Carbide particles.

2. A method according to claim 1, wherein the spray gun comprises a gun body and a fluid nozzle comprising a bore, wherein said fluid nozzle is located in said gun body, said bore comprising a seat and a restrictive area.

3. A method according to claim 1, wherein the temperature of the compressed air is kept between 50 and 75 degrees C.

4. A method according to claim 1, wherein the temperature of the viscous two component coating material is kept at between 32 and 55 degrees C.

5. A method according to claim 1, wherein the pressure of the compressed air is between 1 and 7 bar, at the spraying means.

6. A method according to claim 1, wherein the temperature of the compressed air is kept between 55 and 70 degrees C.

7. A method according to claim 1, wherein the temperature of the viscous two component coating material is kept between 35 and 50 degrees C.

8. A method according to claim 1, wherein the pressure of the compressed air is between 4 and 6.5 bar at the spraying means.

* * * * *

UNITED STATES PATENT AND TRADEMARK OFFICE

CERTIFICATE OF CORRECTION

PATENT NO. : 8,980,378 B2
APPLICATION NO. : 13/582672
DATED : March 17, 2015
INVENTOR(S) : Thomas Soegaard Jensen et al.

It is certified that error appears in the above-identified patent and that said Letters Patent is hereby corrected as shown below:

On the Title Page

(73) Assignee: "Vejle (DE)" should read – Vejle (DK).

Signed and Sealed this
Thirtieth Day of June, 2015

Michelle K. Lee

Michelle K. Lee
*Director of the United States Patent and Trademark Office*